United States Patent [19]

Wurtz

[11] 4,360,975

[45] Nov. 30, 1982

[54] PERSPECTIVE DRAWING MACHINE

[76] Inventor: Frank R. Wurtz, 4570 Apricot Rd., Simi Valley, Calif. 93063

[21] Appl. No.: 109,343

[22] Filed: Jan. 3, 1980

[51] Int. Cl.[3] ..... B43L 13/14
[52] U.S. Cl. ..... 33/432
[58] Field of Search ..... 33/432–434, 33/445

[56] References Cited

U.S. PATENT DOCUMENTS 3,714,714 2/1973 Bullard ..... 33/445
3,826,007 7/1974 Senshu et al. ..... 33/432

FOREIGN PATENT DOCUMENTS 78072 6/1949 Czechoslovakia ..... 33/432
272068 10/1913 Fed. Rep. of Germany ..... 33/432

*Primary Examiner*—Charles E. Phillips

[57] ABSTRACT

This invention relates to a perspective drawing machine and more particularly, to a machine which will keep track of a chosen vanishing point. Two machines are disclosed; one, a mechanical machine works to ±22.5 degrees with an error of ±4.7%. The second is an electronic machine that corrects for the above error and can have a much wider range. Both machines convert instantly from the left hand vanishing point to the right hand vanishing point and then to a standard drafting machine when required.

17 Claims, 22 Drawing Figures

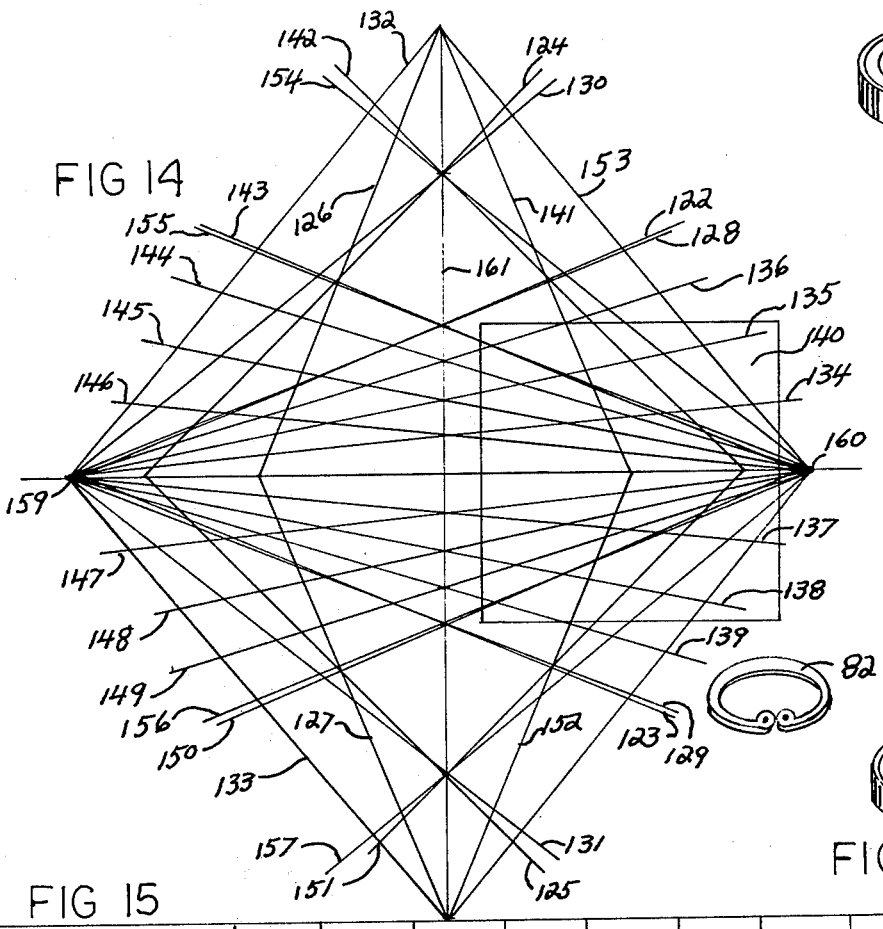
FIG 14
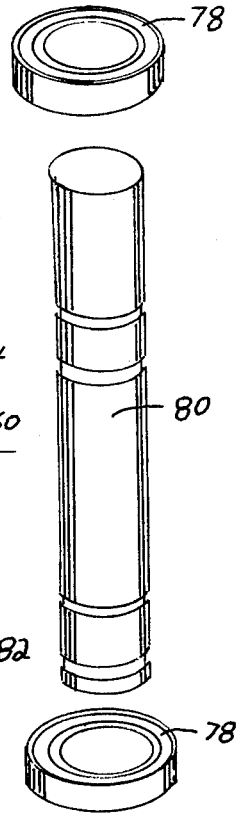
FIG 16
FIG 15
| | 0.3515625° | 5.625° | 11.25° | 16.875° | 22.5° | 28.125° | 33.75° | 39.425° | 45° | 67.5° |
|---|---|---|---|---|---|---|---|---|---|---|
| A INCH | 1.5 | 3 | 6 | 9 | 12 | 15 | 18 | 21 | 24 | 36 |
| B INCH | 30.56 | 30.46 | 30.16 | 29.67 | 29 | 28.06 | 26.94 | 25.54 | 24 | 14.9 |
| % ERROR | 0 | 0.3 | 1.3 | 2.9 | 5.2 | 8.2 | 11.8 | 16.4 | 21.5 | 51.2 |
| CORRECTED ANGLE | .035 | 5.61 | 11.2 | 16.4 | 21.5 | 26.1 | 30.5 | 34.5 | 38.1 | 49.1 |
| ANGLE % ERROR % | 0 | 0.3 | 1.3 | 2.8 | 4.7 | 7.2 | 9.6 | 12.5 | 15.3 | 26.4 |
| MULTIPLIER | 1 | .997 | .987 | .972 | .953 | .928 | .904 | .875 | .847 | .735 |
| CORRECTED B INCH | 30.56 | 30.54 | 30.58 | 30.58 | 30.54 | 30.61 | 30.56 | 30.56 | 30.61 | 30.53 |
175 176 177 178 179 180 181 182

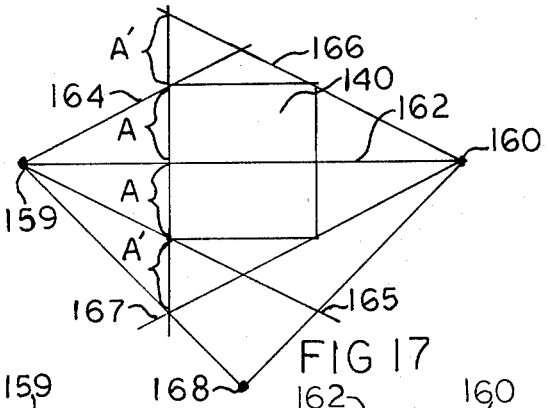
FIG 17
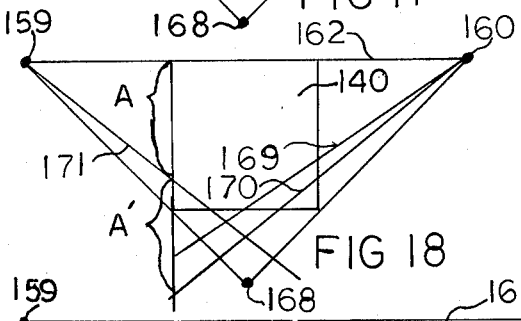
FIG 18
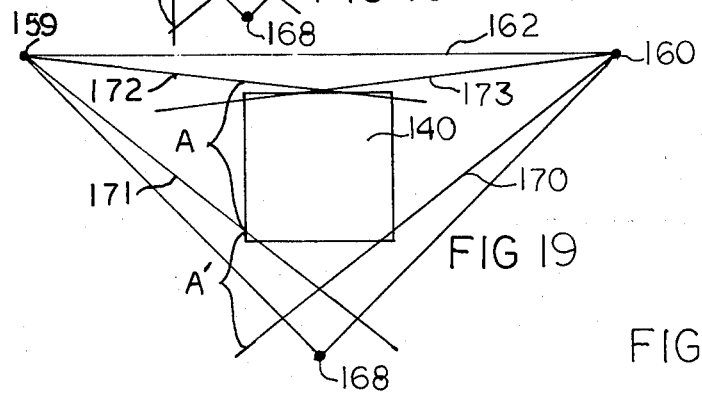
FIG 19
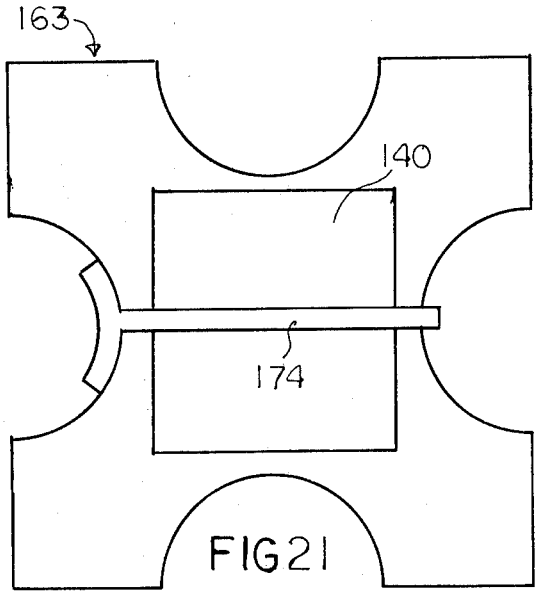
FIG21
FIG 20
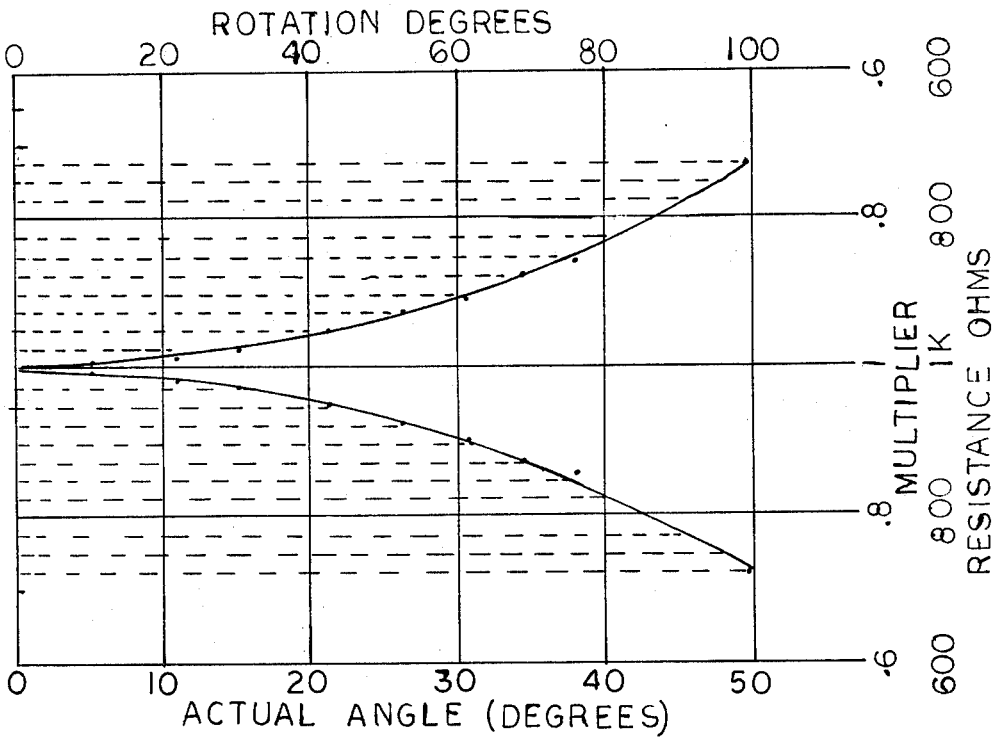

PERSPECTIVE DRAWING MACHINE

BACKGROUND OF THE INVENTION

1. Field of the Invention

This invention relates to the field of drafting or more particularly to the field of perspective drawing. Furthermore it relates to perspective drawing machines that keep track of chosen vanishing points rather than machines that produce a perspective of an object from plane views of the object.

2. Description of the Prior Art

In the past there have been several methods to produce a perspective drawing:

A. By measuring every line to make that line point to an invisible vanishing point.

B. By using educated guesses which takes many years of practice and only very experienced people produce perspective drawings in this manner.

C. A special drafting table shown in FIG. 21 can be used however the vanishing points are fixed and cannot be changed and it cannot be converted to a standard drafting machine. I do not know if this machine is patented.

D. There are machines that can produce a perspective drawing of an object from plane views thereof such as conventional plan, front and side elevations: one such patent is described in U.S. Pat. No. 2,714,253.

Therefore there has been a long standing need for a machine that will keep track of the chosen vanishing points and that can be alternated quickly from a left hand vanishing point to a right hand vanishing point and then to a standard drafting machine when required. There has also been a long standing need for a machine that a high school student could understand to master the technique of perspective drawing.

SUMMARY OF THE INVENTION

Accordingly, the problems and difficulties encountered with the prior systems are obviated by the present invention which provides a perspective drawing machine simple enough to be used by anyone with very little training.

Since there are two basic machines I shall begin with functions that are common to both and then functions that are common to only one machine.

Both machines begin with the basic linear gear, which is the key to this machine, running the length or width of the drawing area plus a little more. A follower gear rides on this linear gear to give an indication of distance moved from a starting point. A shaft runs upwards from this follower gear to a motor on top if needed.

From here the action branches off in two directions. For the mechanical perspective drawing machine either of two sets of step down gear ratios may be chosen at will, each terminating in an output gear which when needed may be attached to the drafting rule.

When one set of gears are attached to the input shaft and to the drafting rule, a movement of the drafting machine along the round ways will result in an automatic circular movement of the drafting rule in the right direction for the vanishing point chosen at the time.

This means that the angle is changed at the Y coordinate instead of at the origin and therefore results in an error which is a minimum for small angles and is approximately ±4.7% for ±22.5 degree angle off the eye level line.

To use this machine the operator must choose the position of his vanishing points and then choose the gear ratio accordingly which fixes the position of these vanishing points being carefull to limit the angle needed from the eye level position to keep the error within a satisfactory limit.

The operator places his drafting rule on the eye level position. He can then lock in either the right or left vanishing points, (LVP or RVP), which ever he is concentrating on at the time. Then when the drafting machine is moved on the round ways the drafting rule also moves in a circular manner to automatically follows the vanishing point within the error limit. When he reaches the position of his next line, he simply draws it knowing that the vanishing point position has been retained. He can then return to the eye level position, switch in the other vanishing point and proceed as before. When he needs a standard drafting machine he places the vanishing point portion in free wheeling and controls the angle of the drafting rule regardless of the position of the follower gear. He can lock the drafting rule at one angle and retain that angle while moving the machine on the round ways.

For the electronic perspective drawing machine the error is removed for any position of the machine on the round ways. In one case the operator changes the circular position of the drafting rule manually for a change of position on the round ways. For the other case a servo system automatically moves the drafting rule in a circular motion to keep the machine always pointing at the chosen vanishing point.

The operator must choose the position of his vanishing point and the minimum and maximum corrected angle that will be needed for both vanishing points. Three examples are shown in FIGS. 17, 18, and 19. With this information the gear ratio for the multiplier potentiometer is chosen to provide the correct multiplier voltage over the range of operation.

To begin with a special potentiometer has to be made with the characteristics shown in FIG. 20. Suppose a one turn potentiometer was made of 2000 ohm total with a fixed center tap at 1000 ohm as shown in R1 in FIG. 23. If a multiturn potentiometer could be made it would cut down on the gear ratio. If only one turn potentiometer could be made try to make the active portion, 1 to 0.6, to cover as much of the total rotation in degrees as possible. As an example I am using ±100 degrees to 0.6 of the total. An accurate curve of rotation VS resistance must be made and actual angle VS multiplier voltage transposed to this curve.

The calculations for the correct gear ratio for the multiplier voltage is as follows: assume three complete turns of the follower gear for each foot of movement of the drafting machine on the round ways. Referring to FIG. 17 and FIG. 20, at ±25 degrees from the eye level position 164 and 165 for the LVP and 50 degree rotation then for ± one foot movement of the drafting machine and ±25 degree rotation (actual angle) the gear ratio would be 1080/50=21.6 to 1. For a ± two foot movement of the drafting machine for ±25 degrees for the right vanishing point the gear ratio would be (360×6)/50=43.2 to 1.

To establish the position of the vanishing points assume a potential from the center tap of R1 to be ±15 volts for a ±67.5 degree rotation of the drafting rule or 0.222222 volts per degree. Then for ±25 degrees the corrected voltage at 120, V8, would be ±5.56 volts. For the left vanishing point move the drafting machine one foot up off the eye level line and adjust V6 and V7 for a corrected voltage at 120, V8 of +5.56 volts. (Note: V6 and V7 are tracking supplies and adjust together, V6 to plus voltage and V7 to an equal but opposite minus voltage.) for the right vanishing point move the drafting machine two feet up off the eye level line and adjust V4 and V5 for a corrected voltage at 120, V8 of −5.56 volts. (NOTE: V4 and V5 are tracking supplies and adjust together, V4 to minus voltage and V5 to an equal but opposite plus voltage.)

For calculation of the distance each vanishing point is off the Y coordinate, proceed as follows: with A=12 inches and the angle ±25 degrees then; B=12/tan 25 degrees=25.7 inches. Therefore the left vanishing point is 25.7 inches to the left of the Y coordinate. To calculate the position of the right vanishing point note that lines 166 and 167 cross the Y intercept at A+A'=24 inches. Therefore the right vanishing point is B=24/tan 25 degrees=51.5 inches. Therefore the right vanishing point is 51.5 inches to the right of the Y coordinate.

In FIG. 18 the machine goes from the eye level to a minus 38 degree actual angle or about 75 degree rotation for about one feet for the left vanishing point.

In FIG. 19 the eye level is above the drawing so both left and right calculations start at minus 7 degrees and end at minus 38 degrees for the left vanishing point and minus 39 degrees for the right vanishing point.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 7 is a perspective which shows the relation of the activator hinges #61 and the clutches #21;

FIG. 14 is a chart showing the errors that occur by changing the angle at the Y coordinate instead of at the pole and showing the corrected angles to keep the machine always pointing to the vanishing point;

FIG. 15 is a chart showing the following things as a function of the uncorrected angle that results by changing the angle on the Y coordinate;

1. Side A in inches
2. The uncorrected length of side B in inches
3. The percent error that results in side B.
4. The corrected angle in degrees
5. The percent error in the two angles
6. The multiplier that results to correct the angle.
7. The corrected length of side B in inches FIG. 16 shows a typical shaft which will use a top and bottom bearing when appropriate and one or more bearing retaining rings;

FIG. 17 shows one perspective drawing set up with the eye level at the center of the drawing;

FIG. 18 shows one perspective drawing set up with the eye level at the top of the drawing;

FIG. 19 shows one perspective drawing set up with the eye level above the top of the drawing;

FIG. 20 shows a graph of the multiplier curve. This curve will be used to produce the non linear potentiometers for the multiplier voltage. The rotational degrees VS ohms or multiplier voltage will also be on this plot to aid in setting up the needed gear ratio. The actual angle in degrees VS multiplier voltage is on this curve also;

FIG. 21 shows the only known other perspective drawing machine that keeps track of the vanishing points;

DESCRIPTION OF THE PREFERRED EMBODIMENT

Figure 1:
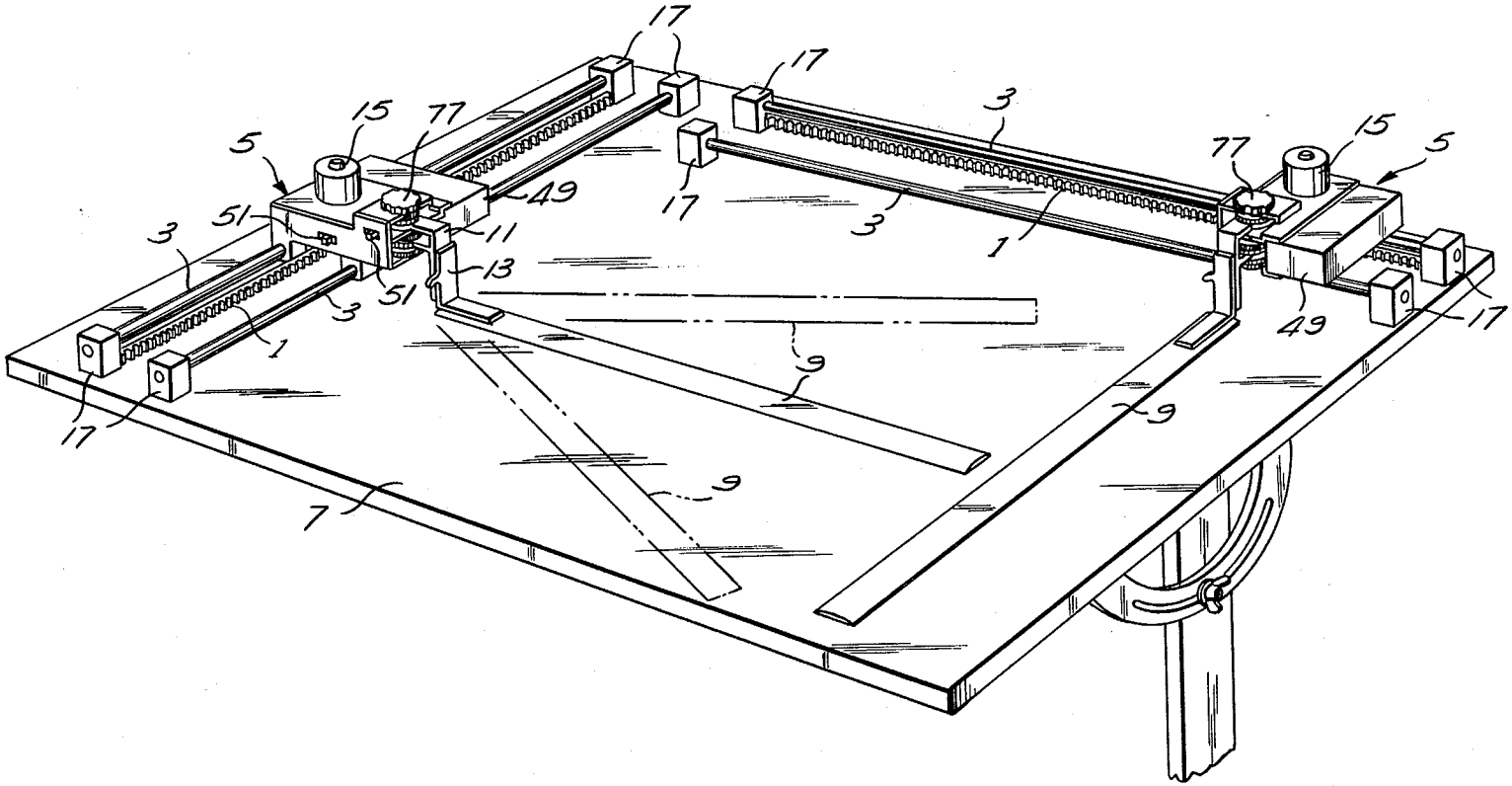
FIG. 1 is a perspective drawing of a drafting table showing two perspective drafting machines, one for the left and right vanishing points and one for the top and bottom vanishing points; (NOTE: the top machine can be used as a standard drafting machine for vertical lines or the left and right machine as a standard drafting machine and the use of right angles can be used for vertical lines.)

Referring to the drawing and particularly FIG. 1, two perspective drawing machines 5 are shown on a drafting table 7. The perspective drawing machine 5 is shown riding on round ways 3 and the linear gear 1 is shown below one of the round ways 2 and connected to the way support blocks 17.

The drafting rule coupler 11 is shown connected to the rule lifting mechanism 13 and the drafting rule 9 is connected thereon. Shown in phantom is the drafting rule rotated at different angles when used as a standard drafting machine or when moved from an eye level to another position for a left vanishing point. The motor 15 connected to the input shaft 37 and the drafting rule knob 77 are on top of the perspective drawing machines 5. The clutch activating handles 51 are also shown.

Figure 2:
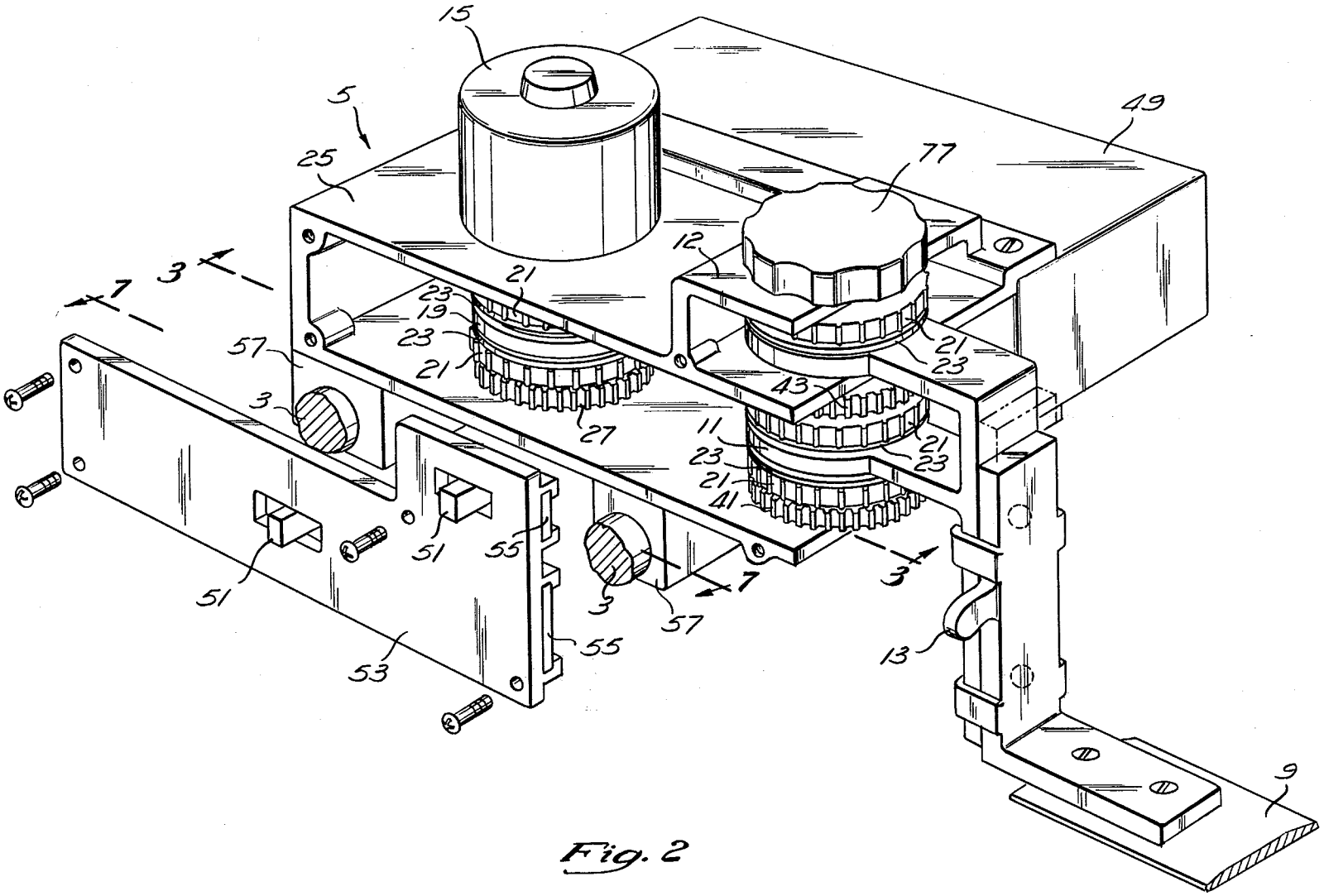
FIG. 2 is a perspective drawing of a mechanical perspective drawing machine showing how the parts go together.

Referring to FIG. 2. A perspective drawing of a perspective drawing machine 5 showing more details.

On the input shaft 37 the following items are identified. The shaft passes through the bottom of the case 25 through the LVP (left vanishing point) input gear 27, hereafter referred to as the LVP input gear, through the clutch 21, the clutch plate 23, the shaft coupler 19, the only part attached solidly to the shaft. Another clutch plate 23, another clutch 21 then through the RVP (right vanishing point) input gear 29 shown in FIG. 1 and through the top of the case 25 to the motor 15. Then comes the threaded hubs 33 (shown in FIG. 4) which are attached to the input gears 27 and 29, upon which the clutches 21 are riding. Next comes the wavespring washers 31 and the clutch plate retainers 39.

Figure 3:
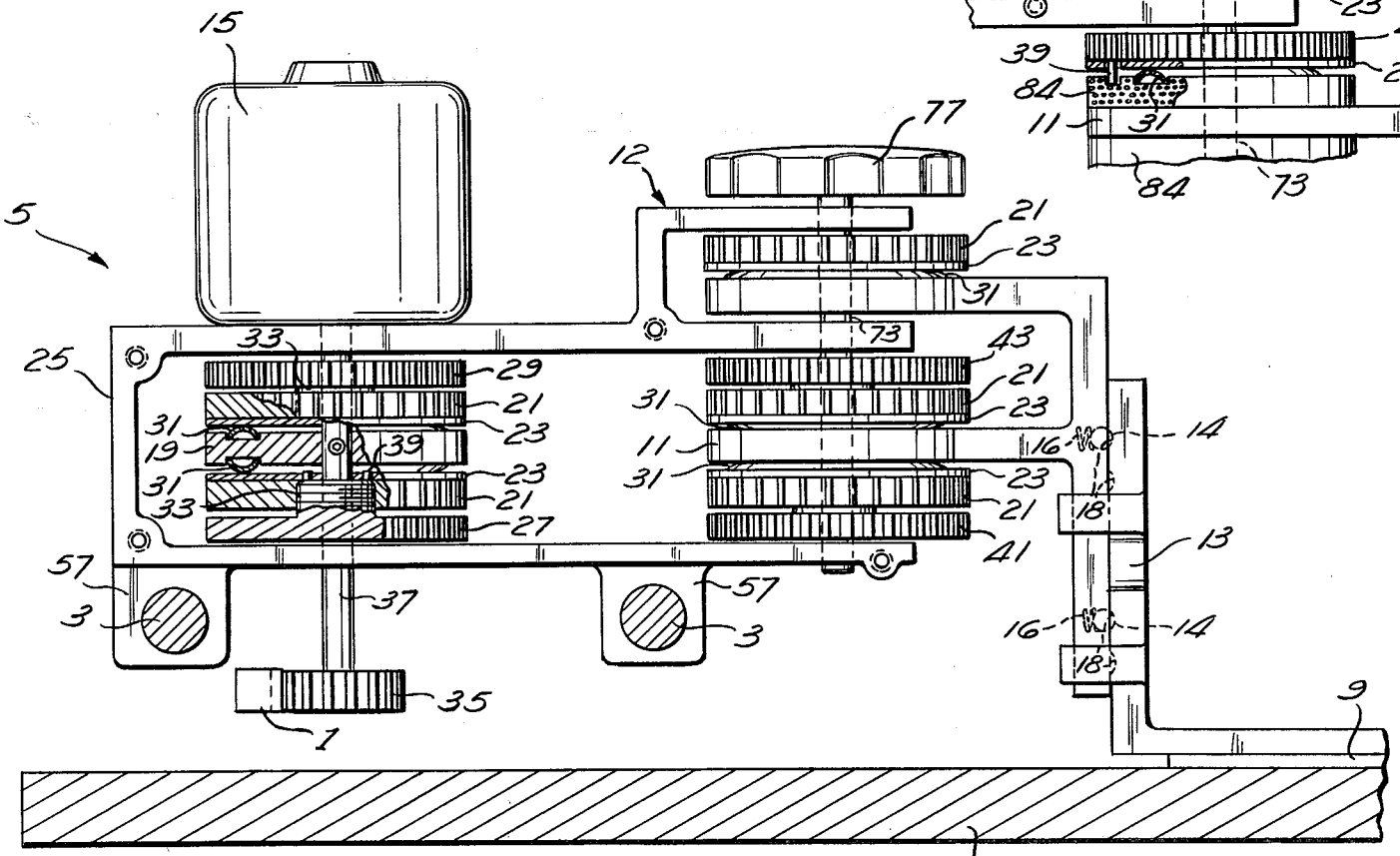
FIG. 3 is a view looking into the machine at 3→ on FIG. 2 showing the arrangement of parts as talked about in the body of this patent application.
Figure 4:
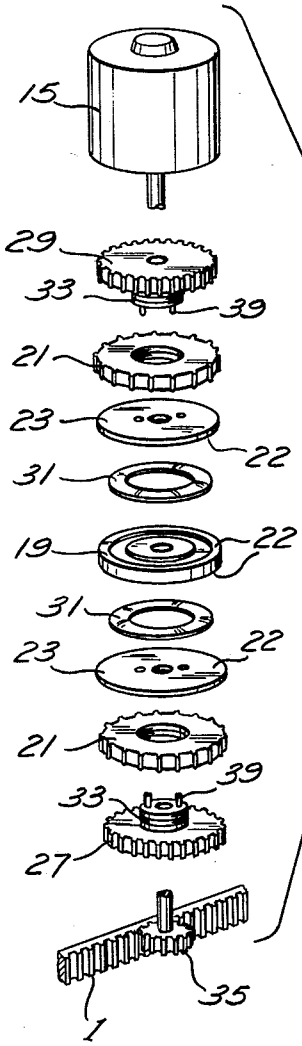
FIG. 4 is an expanded perspective drawing of the input gear and input shaft showing all of the parts that are on or attached to the shaft.
Figure 10:
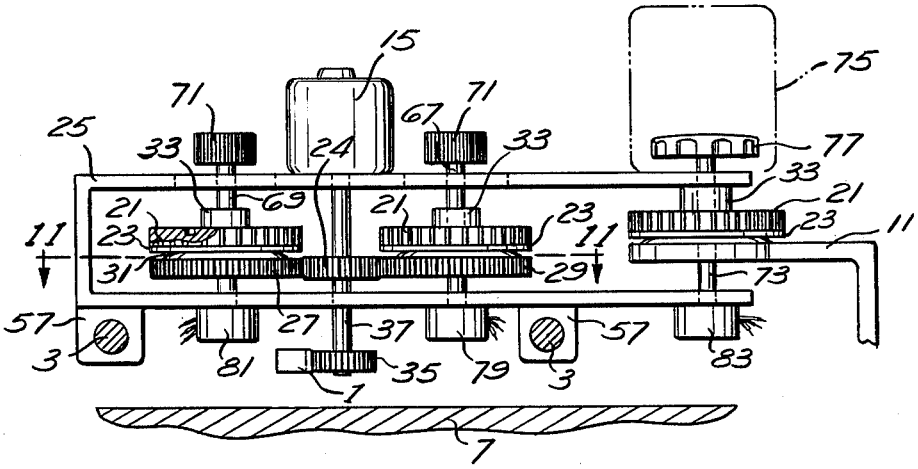
FIG. 10 is a flat drawing of the electronic perspective drawing machine. It is the same configuration as FIG. 3.

On the output shaft 73 see FIG. 3 and FIG. 10 the following items are identified. After the shaft 73 passes through the bottom of the case 25, it passes through the LVP output gear 41, then comes a clutch 21, a clutch plate 23, then the first part of the drafting rule coupler 11, which is connected solidly to the shaft. Another clutch plate 23, another clutch 21 followed by the RVP output gear 43. The shaft then passes through the top of the case 25, through the second part of the drafting rule coupler 11, also connected solidly to the shaft, then comes the clutch plate 23 and the clutch 21, then through the top of the rule control frame 12 to the drafting rule knob 77. Also on the output shaft are the threaded hubs 33, shown in FIG. 4, two of which are attached to the output gears 41 and 43, and one of which is attached to the rule control frame 12, also see FIG. 3 and FIG. 10 the wavespring washers 31 and the clutch plate retainers 39 are shown in FIG. 4.

On the back of the machine in FIG. 2 can be seen the gear ratio box 49 which contain the intermediate gears for the LVP (left vanishing point) 159 and the RVP (right vanishing point) 160. It is thought that for major changes a new gear ratio box 49 can be kept on hand for several well used sets of vanishing points 159, 160, and the entire gear ratio box 49 changed in one piece.

The case 25 is supported on the round ways 3 by the ball bushing pillow blocks 57 which allows free movement on the round ways 3.

On the front is the clutch system which includes an immovable plate 53 supporting a movable plate 55 attached to a clutch activating handle 51.

On the front the rule lifting mechanism 13 is attached to the drafting rule coupler 11 and the drafting rule 9 attaches to the rule lifting mechanism.

Referring to FIG. 3 a perspective drawing machine 5, cutout view of a cut shown as 3 in FIG. 2 will be described. The linear gear 1 attaches to two way support blocks 17 and a follower gear 35 rides on the linear gear 1 to give an indication of distance moved from a reference position. The input shaft 37 is attached solidly to the follower gear 35 and goes upwards through the case 25 to the LVP input gear 27, attached to this LVP input gear 27 is a threaded hub 33. Riding on this threaded hub 33 is a clutch 21 then a clutch plate 23, attached to the threaded hub 33 by clutch plate retainers 39 to prevent circular motion with respect to the threaded hub 33. A wavespring washer 31 is between the clutch plate 23 and the shaft coupler 19 to push the non slip surfaces 22, shown in FIG. 4, apart when disengaging. The shaft coupler 19 is attached solidly to the shaft 37. Following the shaft coupler 19 is another wavespring washer 31 then another clutch plate 23, another clutch 21 riding on another threaded hub 33 and clutch plate retainers 39 for the clutch plate and the RVP input gear 29 attached solidly to the threaded hub 33. The shaft then passes through the case 25 to the motor 15.

On the output side the output shaft 73 passes through the bottom of the case 25 to the LVP output gear 41. Then comes the clutch 21, the clutch plate 23, the first part of the drafting rule coupler 11, which is solidly connected to the shaft 73, then another clutch plate 23, another clutch 21 and the RVP output gear 43. Shown between the first part of the drafting rule coupler and the clutch plates are the wavespring washers 31. Attached to the output gears 41 and 43 are the threaded hubs 33. The shaft then passes through the top of the case 25, through the second part of the drafting rule coupler 11, another clutch plate 23, another clutch 21 and then through the rule control frame to the drafting rule knob 77. Again between the second part of the drafting rule coupler and the clutch plate is the wavespring washer 31. Another threaded hub 33 is attached tightly to the rule control frame 12. All threaded hubs contain clutch plate retainers 39 shown in FIG. 4.

Riding on the round ways 3 are shown two open ball bushing pillow blocks 57. Attached to the drafting rule coupler is the rule lifting mechanism 13 and a drafting rule 9 attached to it. The rule lifting mechanism is controlled by indents 18 and ball bearings 14 controlled by an indent spring 16.

FIG. 4 is an exploded view of the input shaft including the following parts. It starts with the linear gear 1 and the follower gear 35 riding on it. Next the shaft passes through a bearing 78 in the bottom of the case to the left vanishing point input gear 27. Next comes the threaded hub 33 which is fastened tightly to the LVP input gear 27. On the threaded hub can be seen the clutch plate retainers 39. Next is shown the clutch 21, which would be threaded on the threaded hub 33, followed by the clutch plate 23 which is held onto the threaded hub 33 by the clutch plate retainers 39. This is followed by a wavespring washer 31 which pushes the clutch plate 23 and the shaft coupler 19 apart when disengaging. Next comes the shaft coupler 19 followed by another wavespring washer 31, another clutch plate 23, another clutch 21, threaded hub 33 and attached solidly to the threaded hub 33 is the RVP input gear 29. Clutch plate retainers 39 are shown on the threaded hub 33. A non slip surface 22, is on the facing portion of the clutch plate 23 and the shaft coupler 19 for both the LVP pole 159 and the RVP pole 160. The shaft then passes through another ball bearing 78 in the top of the case and into the motor 15. The only parts that are attached solidly to the input shaft is the follower gear 35, the shaft coupler 19, and the motor 15.

Figure 5:
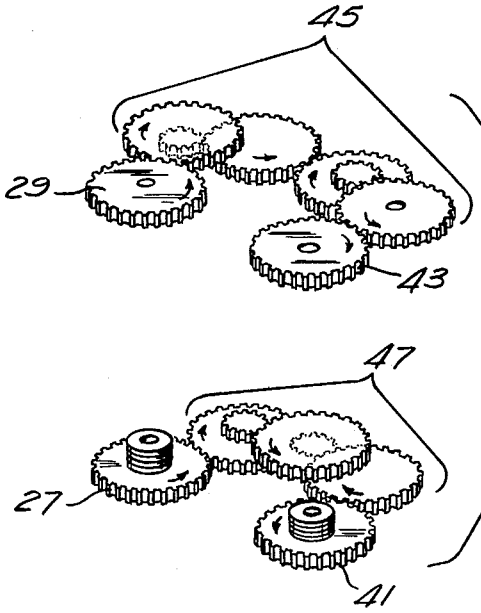
FIG. 5 shows the input and output gears and the additional gears that are in the gear box which completes the gear ratio.

FIG. 5 is a representative showing of the gear ratios which establish the position of the vanishing points. In the bottom set of gears is shown the LVP input gear 27, and the LVP output gear 41. The gears in between, the LVP gear ratio 47 is described as a multiplicity of gears which along with the LVP input gear 27 and the LVP output gear 41 establish the position of the LVP 159.

In the top set of gears the same thing happens for the RVP 160. The RVP gear ratio 45 attaches to the RVP input gear 29 and the RVP output gear 43.

Note that a counter clock wise rotation for the LVP input gear 27 results in a counter clockwise rotation of the LVP output gear 41, while a counter clockwise rotation of the RVP gear 29 results in a clockwise rotation of the RVP output gear 43.

Figure 6:
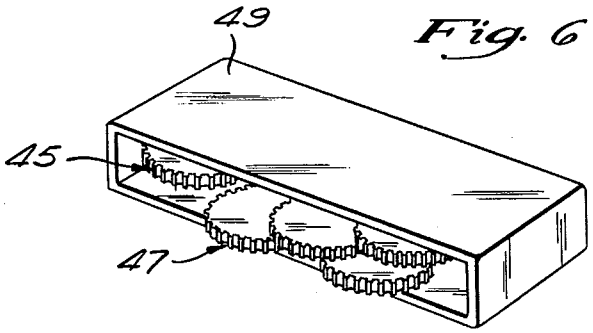
FIG. 6 shows the gear ratio box that will be changed as one piece to change to different vanishing points.

Referring to FIG. 6, this is a drawing of a gear ratio box 49 into which the LVP gear ratio 47 and the RVP gear ratio 45 will be mounted. To change the gear ratio by a small amount individual gears may be changed or the entire gear box may be changed for a new gear ratio.

Figure 7:
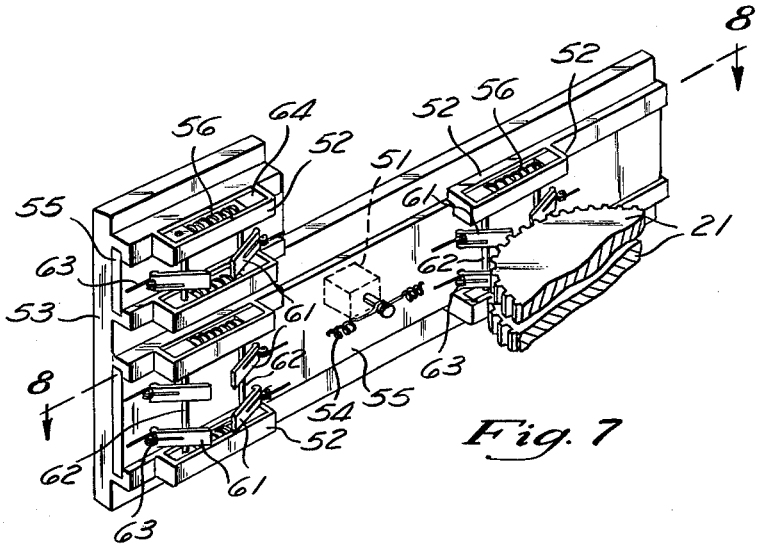
FIGS. 7, 8, and 9 schematically illustrates one means of locking into play the gear ratio needed.
Figure 8:
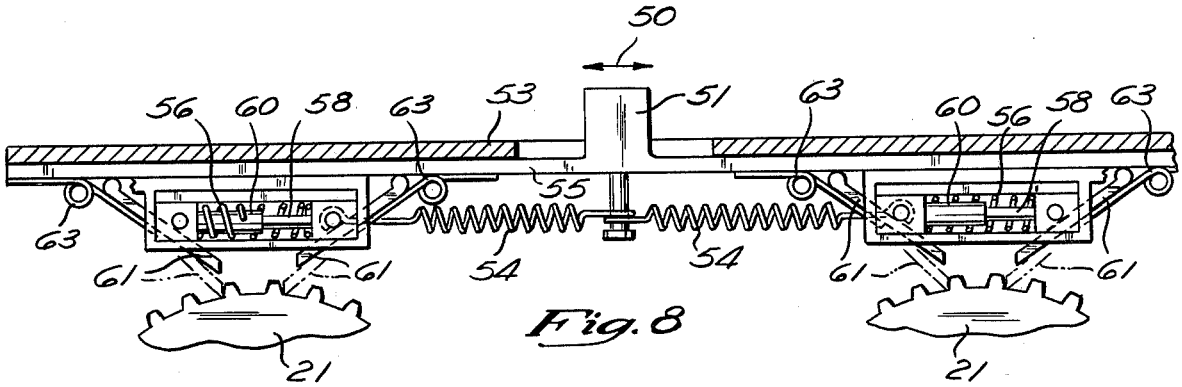
Figure 9:
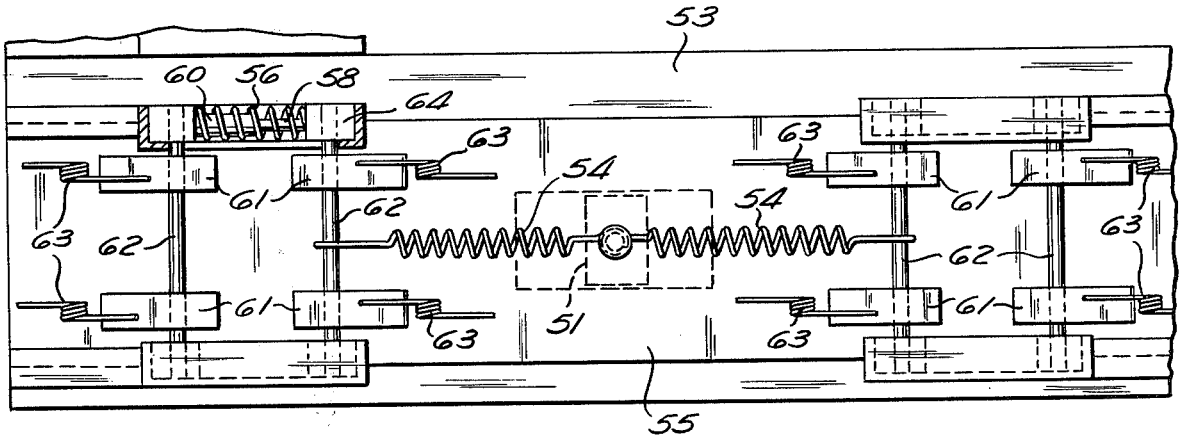

Referring to FIGS. 7, 8, and 9, this schematically illustrates one means of locking into play the gear ratio needed for the next line on the drawing that is needed. In these figures an immovable plate 53 surrounds a movable plate 55. For each clutch activator system there are included two roller frames 52 inside of which are two roller bearings 64, an inner guide 58, and an outer guide 60, around which is a compression spring 56, and coming out of each roller bearing 64 is a roller 62. Leaning on the rollers 62 for each clutch 21, that needs to be activated are two activator hinges 61, and a tortion spring 63, for each activator hinge 61. Activator hinges 61 and tortion springs 63, are attached to and pivoted on movable plate 55 by a special means.

The movable plate 55 is controlled by the clutch activating handle 51 and the clutch centering springs 54. As the clutch activating handle 51 is moved in either direction indicated by the arrow 50 (FIG. 8) the activator hinges 61 are moved to the positions shown partially in phantom and therefor cause the clutch 21 to move in one direction by one or more teeth at a time to bring the non slip surfaces 22 tightly together. When the clutch activating handle 51 is released the clutch centering springs 54 will bring the mechanism back to center unloading the gear system so it is free to rotate.

The rest of the drawings are concerned with the electronic perspective drawing machine. Referring to FIG. 10 the perspective drawing machine 5 is shown riding on the round ways 3 supported by the ball bushing pillow blocks 57. The linear gear 1 is supported by the way support blocks and the follower gear 35 rides on the linear gear 1. The input shaft 37 attached to the follower gear 35 and travels upward to and through the case 25 to the input gear 24 on up through the case 25 to the motor 15. Coupled to the input gear 24 are two gears, the LVP input gear 27 and the RVP input gear 29, going through the LVP input gear is the LVP shaft 69 of the LVP potentiometer 81 which is tightly attached to the case 25, going through the RVP input gear 27 is the RVP shaft 67 of the RVP potentiometer 79, which is tightly attached to the case 25. The input gears 27 and 29 are riding loosely on the shafts 67 and 69. Attached tightly to the shafts 67 and 69 are threaded hubs 33 and riding on these hubs are clutches 21 and clutch plates 23. Between the input gears 27 and 29 and the clutch plates 23 are wavesprings washers 31 which push these members apart when not energized. Clutch plate retainers 39, shown in FIG. 4, keep the clutch plate 23 loosely connected vertically to the threaded hub 33 while preventing circular motion with respect to the threaded hub. A non slip surface 22 again exists on the facing portion of the clutch plate 23 and the input gears 27 and 29. The shafts 67 and 69 then continue upwards through a hole in the top of the case 25 to knobs 71.

Attached to the output shaft 73 is a one turn potentiometer 83 the purpose of which is to give a voltage potential proportional to the circular movement of the drafting rule. The output shaft 73 then passes through the drafting rule coupler 11 which is tightly coupled to the output shaft 73 then through the threaded hub 33 which is tightly connected to the case 25 and then upwards to either a rule control knob 77 or to a servo motor 75. Attached to the threaded hub 33 are the clutch 21 and clutch plate 23.

Figure 12:
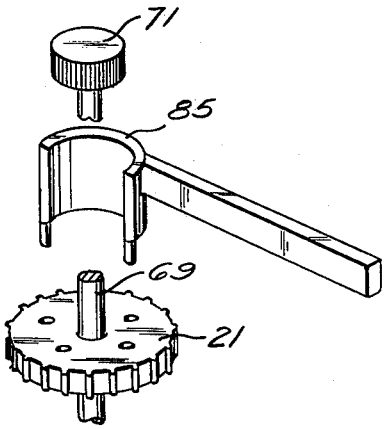
FIG. 12 shows the clutches used on the left and right vanishing point potentiometers and the left and right vanishing point multiplier potentiometer and shows a spanner wrench that could be used to loosen or tighten the clutches when needed.

Referring to FIG. 12 a clutch 21 is shown with a shaft 69 and the knob 71. It will be seen that the clutch 21 has spanner wrench holes in it to accept a spanner wrench 85 through the holes in the top of the case 25.

Figure 11:
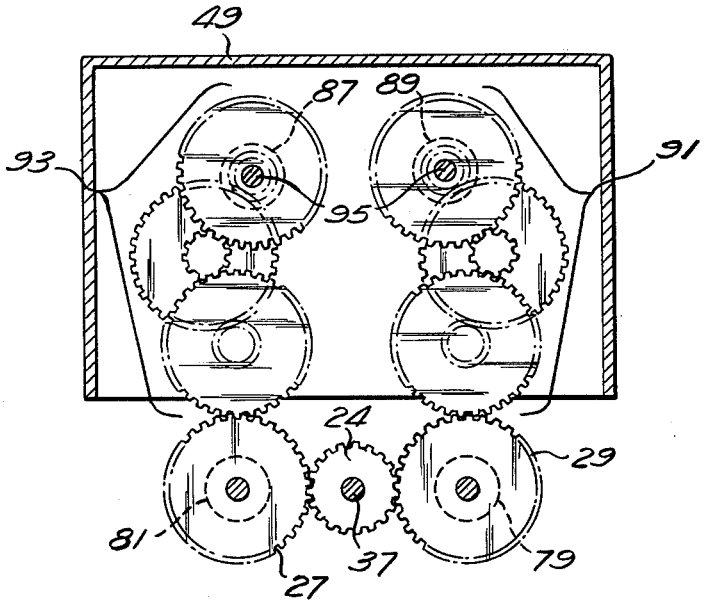
FIG. 11 is a flat drawing showing the gear arrangement for the step down multiplier potentiometers. (NOTE: this gear box could be divided into two parts, a separate section for each vanishing point.) The clutch arrangement shown in FIG. 10 for the left and right vanishing point potentiometers is also used for the left and right vanishing point multiplier potentiometers.

The system just described is exactly the same system that will be found on the shafts of the multplier potentiometers 87 and 89 shown in FIG. 11 with the shafts replaced by the multiplier output shafts 95 and the gear 27 and 29 replaced by the output gears in the LVP gear ratio 93 and the RVP gear ratio 91. These gear ratios 91 and 93 along with the multiplier potentiometers 87 and 89 would be changed as either one or two gear ratio boxes 49 complete for one or a set of vanishing points to give the proper range of multiplier potentials for the drawing area chosen.

On the input shaft 37 on top of the case 25 can be seen the motor 15 that can be used. The machine could be manually moved on the round ways.

The output shaft 73 is the shaft of the output potentiometer 83 and the drafting rule coupler 11 is tightly connected to this shaft 73. A threaded hub 33 is tightly connected to the case 25 and a clutch plate 23 is attached to this threaded hub 23 by clutch plate retainers and a clutch 21 is riding on this threaded hub 33. The shaft 73 passes through the top of the case 25 to either a manual drafting rule knob 77 or a servo motor 75 shown in phantom. The output clutch system is controlled by the same single clutch activating system shown and described in FIGS. 7, 8, 9, and FIG. 13.

Figure 13:
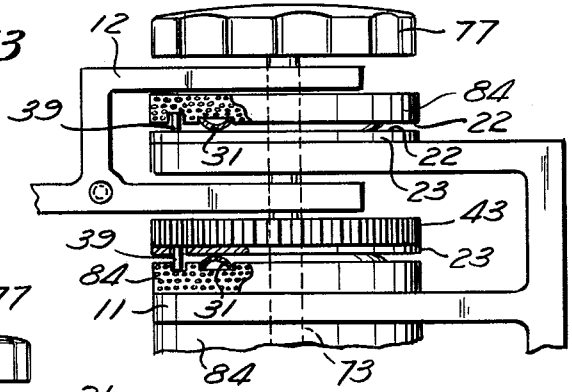
FIG. 13 is a drawing changing the mechanical clutches to electric clutches using an electro-magnet to bring the two non slip surfaces tightly together. The upper clutch would connect the drafting rule coupler tightly to the case for a standard drafting rule and the lower is only the output clutch for the right vanishing point. A similar clutch would be on the input shaft for both the left and right vanishing point and on the output shaft for the left vanishing point.

Referring to FIG. 13 the clutch systems shown in FIGS. 2 and 3 may be replaced by the electro magnet clutch as follows: The standard drafting clutch and the RVP output clutch only are shown as follows: The RVP output clutch includes an electro magnet 34 on top of and connected solidly to the first part of the drafting rule coupler which should be non magnetic material, followed by a clutch plate 23 which is made of magnetic material and then the RVP output gear 43 which should be made of non-magnetic material. Holding the clutch plate 23 to the RVP output gear 43 are clutch plate retainers 39 which prevent circular movement of the clutch plate with respect to the output gear 43. A wavespring washer 31 between the electro magnet 34 and the clutch plate 23 push these items apart when the electro-magnet is de-energized.

The LVP output clutch would be exactly the same but opposite and ending with the left vanishing point output gear. The same systems would be on the input shaft with the shaft coupler replacing the drafting rule coupler.

Following the output shaft 73 through the top of the case and through the second part of the drafting rule coupler 11 which is tightly connected to the output shaft 73 then comes a clutch plate 23 connected to the second part of the drafting rule coupler 11 by clutch plate retainers 39 and made of magnetic material. This is followed by another electro magnet 34 which is connected solidly to the rule control frame 12. Again wavespring washers 31 between the electro magnet and the clutch plate push them apart when the electro magnet is de-energized. Again the facing portion of the electro magnets 84 and the clutch plates 23 have a non slip surface 22 so that when the electro magnet 84 is energized these non slip surfaces are brought tightly together and from then on the two must move together when movement occurs.

To operate these electro magnets 84 a slip ring assembly will have to be incorporated on the input and output shafts 37 and 73.

Referring to FIG. 14 one set of vanishing points 159 and 160 and the uncorrected angles and the corrected angles that would be used are shown below. The drawing on the drafting table is 140. The uncorrected angles are shown in chart form below:

| For the LVP (left vanishing point): | | For the RVP (right vanishing point): | |
|---|---|---|---|
| Number | Angle in Degrees | Number | Angle in Degrees |
| 122 | 22.5 | 141 | 67.5 |
| 123 | −22.5 | 142 | 45.0 |
| 124 | 45.0 | 143 | 22.5 |
| 125 | −45.0 | 144 | 16.875 |
| 126 | 67.5 | 145 | 11.25 |
| 127 | −67.5 | 146 | 5.625 |
| 134 | 5.625 | 147 | −5.625 |
| 135 | 11.25 | 148 | −11.25 |
| 136 | 16.875 | 149 | −16.875 |
| 137 | −5.625 | 150 | −22.5 |
| 138 | −11.25 | 151 | −45.0 |
| 139 | 16.875 | 152 | −67.5 |

The corrected angles are shown in chart forms below:

| For the LVP (left vanishing point): | | For the RVP (right vanishing point): | |
|---|---|---|---|
| Number | Angle in Degrees | Number | Angle in Degrees |
| 128 | 21.5 | 153 | 49.1 |
| 129 | −21.5 | 154 | 38.1 |
| 130 | 38.1 | 155 | 21.5 |
| 131 | −38.1 | 156 | −21.5 |
| 132 | 49.1 | 157 | −38.1 |
| 133 | −49.1 | 158 | −49.1 |

Referring to FIG. 15 a chart has been prepared showing for the uncorrected angles in column 175 the length of A 176, the length of B 177 as a result of changing the angle at the Y coordinate or at A instead of at the pole or vanishing point. The percent error 178. When the corrected angle 179 is calculated and the angle error in percent 180 is shown. Next the multiplier voltage 181 is calculated and the corrected B 182 in inches is calculated to check whether the corrected angle is right.

Referring to FIG. 16 whenever any shaft 80 passes through the case it should have a bearing 78 and retaining rings 82 to support its position vertically.

Referring to FIG. 17 through FIG. 19 three vanishing point configurations are shown. The station points 168 the LVP's 159 and the RVP's 160 are shown in each. In FIG. 17 the eye level line 162 is in the center of the drawing 140 and the angles needed are +25 degrees 164 and 166 and −25 degrees 165 and 167 for the right and the left vanishing point 160 and 159 respectively. In FIG. 18 the eye level line 162 is at the top of the drawing and the angles needed are −38 degrees for the LVP 159 and −33 degrees 169 and −39 degrees 170 for the RVP 160. In FIG. 19 the eye level line 162 is above the drawing so the difference between two angles must be used. For the LVP 159 the angles used would be between −7 degrees 172 and −38 degrees 171 and for the RVP's 160 the angles used would be between −7 degrees 173 and −39 degrees 170.

FIG. 20 is a plot showing the multiplier voltage curve that will have to be duplicated closely to cancel the error produced by changing the angle at the Y coordinate instead of at the origin. I know that a one turn carbon potentiometer could be made to duplicate this curve and if a multi-turn potentiometer could be made it would make the multiplier gear ratio much less. When making this potentiometer the active portion (1 to 0.6) should be as large a percentage of the total rotation as is possible. The rotation VS resistance in ohms must be plotted accurately and the actual angle VS multiplier voltage transposed to this curve. It is suggested that an accurate one volt supply be connected to the center tap of this potentiometer to produce the multiplier potential directly.

FIG. 21 is only a drawing showing one method of making perspective drawings and it shows a specially built drafting table 163 and a T square 174 built for the drafting table 163. The vanishing points cannot be changed and it cannot be converted to a standard drafting machine.

Figure 22:
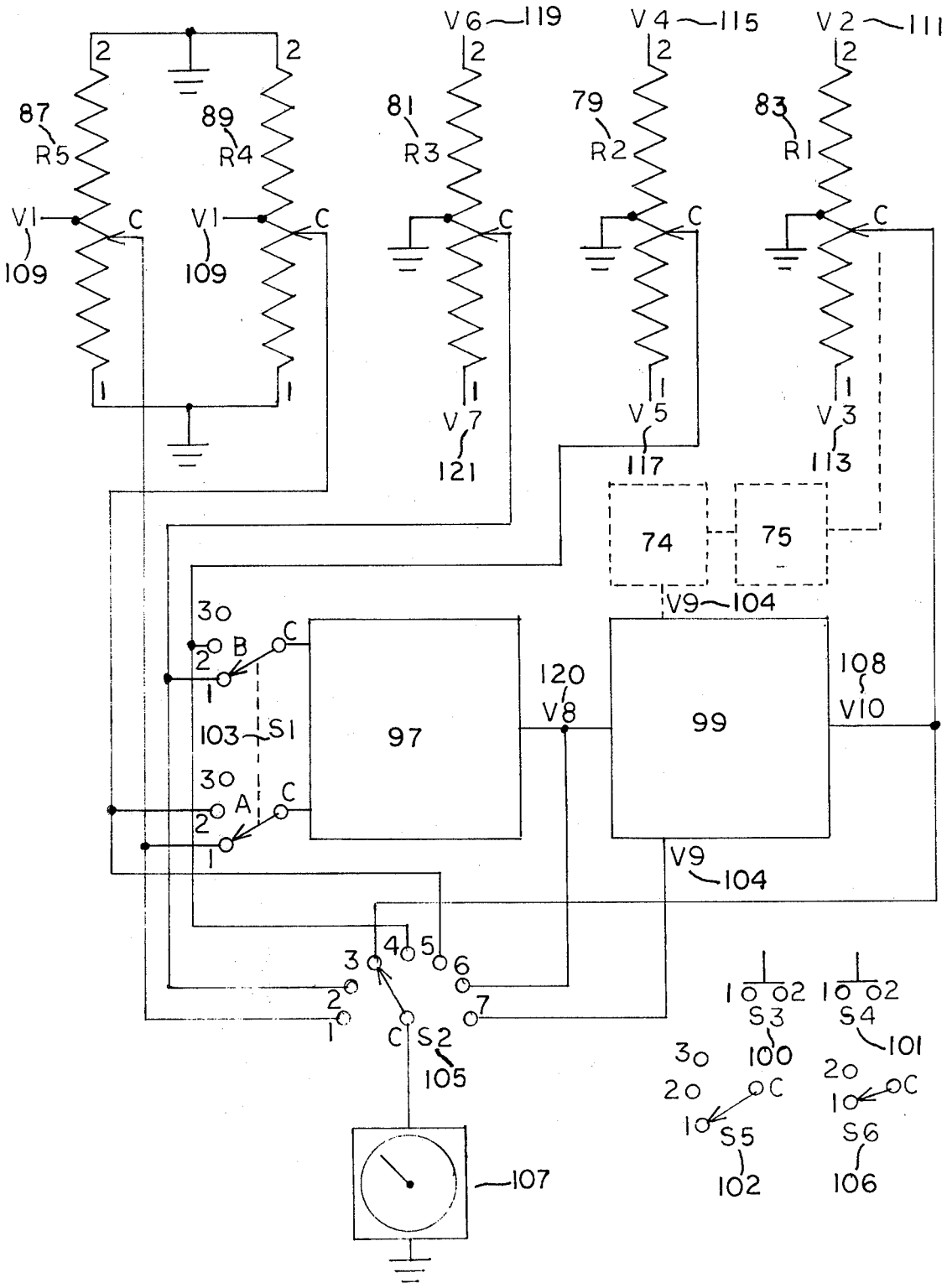
FIG. 22 is an electrical schematic and block diagram showing the electrical perspective drawing machine and other electrical components needed for both machines.

Referring to FIG. 22 a combination schematic and block diagram is shown of the electronic perspective drawing machine where the LVP and RVP multiplier potentiometers 87 and 89 respectively are shown with a fixed center tap where the one volt reference, V1, 109 is connected. The potentiometers are made special with an impedance curve like that shown in FIG. 20 and the connection at 1 and 2 are connected to the V1, 109, return.

The LVP potentiometer 81 and the RVP potentiometer 79 are ten turn potentiometers such that with three turns of the follower gear 35 per foot and two to one reduction from the input gear 25 and the LVP and RVP input gears 27 and 29 then the LVP and RVP potentiometers 81 and 79 would turn ± four and one half turns for a ± three foot movement of the machine on the round ways. The LVP and RVP potentiometers 81 and 79 would also have a fixed center tap which would be tied to the power return. The number one end of the LVP potentiometer would be connected to a variable negative supply V7, 121, and the number two end would be connected to a variable positive supply V6, 119. The number one end of the RVP potentiometer 79 would be connected to a variable positive supply V5, 117, and the number two end would be connected to a variable negative supply V4, 115. V7, 121, and V6, 119, would be varied together and be equal and opposite polarities and V5, 117, and V4, 115, would be varied together and be equal and opposite polarities.

The output potentiometer 83 would also have a fixed center tap and the number one side would be connected to a negative power supply V3, 113, and the number two side would be connected to a positive power supply V2, 111. V1, 113 and V2, 111, would be equal and opposite potentials. A clockwise rotation of the drafting rule would cause a negative voltage at V10 and a counter clockwise rotation would cause a positive voltage at V10.

The variable center taps of all these potentiometers would go to the RVP-LVP switch S1A and S1B, 103 and S2, 105. When commanded, the multiplier 97 would receive at its inputs the center taps of S1A and S1B and would multiply the left vanishing point voltage on the center tap of R3, 81 (at S1B−1) by the LVP multiplier voltage on the center tap of R5, 87 (at S1A−1) to come up with a LVP corrected voltage V8 or it could receive at its inputs the RVP voltage on the center tap of R2, 79 (at S1B−2) to be multiplied by the RVP multiplier voltage on the center tap of R4, 89, at (S1A−2) to come up with a RVP corrected voltage V8, 120. V8, 120, could then be compared with V10 by the computer 99 and the output potentiometer R1, 83, varied either manually or by the servo system 74 and the servo motor 75 shown in phantom until the computed voltage output V9, 104 is reduced to zero.

The multipole rotary switch S2, 105, is used to send the following voltages to the vacuum tube voltmeter 107: At S2, pin one, the LVP multiplier voltage at the center tap of R5, 87, at pin five the RVP multiplier voltage at the center tap of R4, 89, at pin three the voltage at the center tap of the output potentiometer R1, V10 108, at pin two the voltage at the center tap of the LVP potentiometer R3, 81, at pin four the voltage at the center tap of the RVP potentiometer R1, 79, at pin six the output voltage of the multiplier V8, 120 and at pin seven the computed voltage V9, 104.

The switches S3, 100, and S4, 101, are meant to be used to operate the motor, one for fast speed and one for slow speed operation.

Switch S5, 102 and S6, 106, could be used in conjunction with the electric clutches 84.

The voltmeter 107 is used to read the voltage, to set up the operation, to check the operation or to manually operate the drafting machine.

What is claimed is:

1. A mechanical perspective drawing machine comprising the combination of:

a linear gear running the length or width of a drawing table;

a follower gear riding on said linear gear to give an indication of a change from a chosen position;

a case to hold said perspective drawing machine;

means to mount said case above said linear gear and to move said case between one chosen position to another chosen position;

an input shaft connected solidly to said follower gear and running upwardly to and through bearings in the bottom of said case, through said case and into and through bearings in the top of said case;

a shaft coupler mounted solidly to said input shaft between the top of said case and the bottom of said case;

an RVP (right vanishing point) input gear below said shaft coupler and riding loosly on said shaft;

an LVP (left vanishing point) input gear above said shaft coupler and riding loosly on said shaft;

a rule control frame;

an output shaft running through a bearing in the bottom of said case upwardly through said case to and through a bearing in the top of said case continuing upward to and through a bearing in said rule control frame;

a drafting rule coupler, having a first part which is between said bottom of said case and said top of said case and a second part which is between said top of said case and said rule control frame, both parts of said drafting rule coupler being solidly connected to said output shaft;

a drafting rule connects to said drafting rule coupler by standard means;

an RVP output gear below said first part of said drafting rule coupler and riding loosly on said output shaft;

an LVP output gear above said first part of said drafting rule coupler and riding loosly on said output shaft;

means to connect said input gears to said shaft coupler and said output gears to said first part of said drafting rule coupler and said second part of said drafting rule coupler to said rule control frame when needed;

means to couple said RVP input gear to said RVP output gear with a pre-calculated ratio and to couple said LVP input gear to said LVP output gear with a precalculated ratio a drafting rule control knob connected to said output shaft outside of said rule control frame;

means to drive said input shaft;

means to lift said drafting rule off a drawing when changing said drafting rule position; and means to secure said shafts vertical position.

2. The invention as described in claim 1 wherein means to couple said RVP input gear to said RVP output gear with a pre-calculated ratio and to couple said LVP input gear to said LVP output gear with a precalculated ratio which comprises:

a gear box which includes:

a multiplicity of gears for said LVP which along with said input and said output gears will establish a gear ratio to obtain the correct vanishing point location with respect to a Y coordinate; and a multiplicity of gears for said RVP which along with said input and said output gears will establish a gear ratio to obtain the correct vanishing point location with respect to said Y coordinate.

3. The invention as defined in claim 1 wherein means to connect said input gears to said shaft coupler and said output gears to said first part of said drafting rule coupler and said second part of said drafting rule coupler to said rule control frame when needed which comprises:

two threaded hubs connected solidly to said input gears, one for RVP below said RVP input gear and one for LVP above said LVP input gear;

two threaded hubs connected solidly to said output gears, one for the RVP below said RVP gear and one for LVP above said LVP output gear;

one threaded hub connected loosely on said output shaft and connected solidly to said rule control frame;

a clutch plate connected to said threaded hub by pins arranged to retain said clutch plate loosely vertically to said threaded hub but to prevent circular movement with respect to said threaded hub;

a non slip surface on one side of said clutch plate and the facing portion of said shaft coupler, and the facing portion of the first and second part of said drafting rule coupler;

a wave spring washer between said clutch plate and facing portion of said shaft coupler and the facing portion of the first and second part of said drafting rule coupler to separate said parts when required; and means to turn said ratchet clutch on said threaded hub to bring said non slip surfaces tightly together.

4. The invention as defined in claim 1 wherein means to connect said input gears to said shaft coupler, and said output gears to said first part of said drafting rule coupler and said second part of said drafting rule coupler to said rule control frame when needed which comprises:

an electro-magnet on both sides of said shaft coupler and attached solidly to said shaft coupler also on both sides of said first part of said drafting rule coupler, and attached solidly to said first part of said drafting rule coupler;

said electro magnets to be the same diameter as said input gears and said output gears;

a clutch plate connected to said input gears and to said output gears by clutch plate retainers which hold said clutch plate loosely vertically while preventing a circular movement of said clutch plate with respect to said gears, said clutch plate to be made of magnetic material;

an electro magnet connected solidly to said rule control frame and a clutch plate connected to the second part of said drafting rule coupler, said clutch plates to be made of magnetic material;

a non slip surface to be on the facing portions of said clutch plates and said electro magnets;

wavespring washers between said clutch plates and said electro magnets to push said non slip surfaces apart when disengaged; and means to couple electro magnet power into said shafts.

5. An electronic perspective drawing machine comprising:

a linear gear running the length or width of a drawing table;

a follower gear riding on said linear gear to indicate a change from a chosen position;

a case to hold said perspective drawing machine;

means to mount said case above said linear gear and to move said case between one chosen position to another chosen position;

an input shaft connected soldily to said follower gear and running upwardly to and through a bearing in the bottom of said case, through said case and into and through a bearing in the top of said case;

a drive gear mounted on said input shaft between the bottom of said case and the top of said case;

an RVP input gear mating with one side of said drive gear;

an LVP input gear mating with the opposite side of said drive gear:

an output shaft passing through said case downwardly through a drafting rule coupler, connected lightly to said output shaft;

a drafting rule connects to said drafting rule coupler by standard means;

means to produce a voltage potential proportional to the change of position of said case for both said RVP and said LVP;

means to produce a multiplier voltage potential for both said RVP and said LVP;

means to produce a voltage potential proportional to a circular movement of said drafting rule from a zero reference potential at an eye level position;

means to lift said drafting rule off a drawing when changing said drafting rule position;

means to compute a correction voltage potential, equal to said voltage potential proportional to the change of position of said case multiplied by said multiplier voltage potential for both said RVP and said LVP;

means to compare said correction voltage potential and said voltage potential proportional to said circular movement of said drafting rule and to give a zero reading when the above compared voltage potentials are equal;

means to drive said input shaft; and means to move said drafting rule in said circular movement until said compared voltage potential is zero.

6. The invention as described in claim 1 or claim 5 wherein means to drive said input shaft which comprises:

a motor connected to the top of said input shaft;

a slow control switch for said motor; and a fast control switch for said motor.

7. The invention as described in claim 1 or claim 5 wherein means to mount said case above said linear gear and to move said case between one chosen position to another chosen position which comprises:

one or more round ways running the length or width of said drawing table;

a way support block at each end of said round ways, said linear gear to be mounted to one set of said way support blocks; and a multiplicity of ball bushing pillow blocks on said round ways to which said case is connected.

8. The invention as described in claim 1 or 5 wherein means to lift said drafting rule off a drawing when changing said drafting rule position which comprises:

a rule lifting mechanism attached to said drafting rule coupler;

a rule lifting handle; and one or more ball bearings and indents which establish the position of said drafting rule.

9. The invention as described in claim 5 wherein means to produce a voltage potential proportional to the change of position of said case for both said right vanishing point and said left vanishing point which comprises:

an RVP ten turn potentiometer connected to the bottom of said case;

an LVP ten turn potentiometer connected to the bottom of said case;

said potentiometers having a fixed tap at the center thereon and a variable tap;

an LVP shaft connected solidly to said LVP potentiometer shaft, extending upwards through said LVP input gear, which is loosly connected to said shaft, continuing upwards through a hole in the top of said case;

means to connect sad LVP input gear to said shaft;

an RVP shaft connected solidly to said RVP potentiometer shaft, extending upwards through said RVP input gear, which is loosly connected to said shaft, continuing upwards through a hole in the top of said case;

means to connect said RVP input gear to said shaft;

means to control the position of said vanishing points; and a control knob at the top of both said LVP and said RVP shafts.

10. The invention as described in claim 7 wherein means to connect said LVP input gear to said shaft and said RVP input gear to said shaft comprises:

a threaded hub connected solidly to said shafts;

a clutch riding on said threaded hub, said clutch is threaded to ride on said threaded hubs threads;

a clutch plate connected to said threaded hub by pins arranged to retain said clutch plate loosely vertically to said threaded hub but to prevent circular movement with respect to said threaded hub;

a non slip surface on one side of said clutch plate and the facing portion of said gear;

a wave spring washer between said clutch plate and the facing portion of said gear to separate said parts when required;

a special spanner wrench to turn said clutch on said threaded hub to bring said non slip surfaces tightly together; and holes in said gears to accomodate said spanner wrench.

11. The invention as described in claim 5 wherein means to produce a multiplier voltage potential for both said right vanishing point and said left vanishing point which comprises:

two carbon potentiometers a left vanishing point gear box;

one of said carbon potentiometers, connected to the bottom of said gear box, said potentiometer shaft running upwards through a hole in the top of said gear box;

an LVP output gear riding loosely on said shaft;

a multiplicity of gears which along with said drive gear and said LVP input gear and said LVP output gear produces a required gear ratio;

means to connect said LVP output gear to said shaft;

a right vanishing point gear box;

one of said carbon potentiometers connected to the bottom of said gear box, said potentiometer shaft running upwards through a hole in the top of said gear box;

an RVP output gear riding loosely on said shaft;

means to connect said RVP output gear to said shaft;

a multiplicity of gears which along with said drive gear and said RVP input gear and said RVP output gear produces a second required gear ratio; and a voltage reference potential of one volt connected to the fixed center tap of both said potentiometers and connections 1 and 2 of said potentiometers to be connected to the negative of said reference potential.

12. The invention as described in claim 5 wherein means to move said drafting rule in said circular movement until said compared voltage potential is zero which comprises:

a manual control knob on the top of said output shaft so that the operator can manually turn said drafting rule.

13. The invention as described in claim 5 wherein means to move said drafting rule in said circular movement until said compared voltage potential is zero which comprises:

a servo control system to automatically sense said compared voltage and a servo motor operated by said servo system to reduce said compared voltage to zero.

14. The invention as described in claim 5 wherein means to produce a voltage potential proportional to said circular movement of said drafing rule from a zero reference potential at an eye level position which comprises:

a single turn linear potentiometer connected to the bottom of said case;

said potentiometer having a fixed center tap and a variable tap;

before tightening said potentiometer on chassis, with said drafting rule on said eye level position said potentiometer is adjusted so that said fixed tap and said variable tap are together;

a plus voltage power source connected to the number two side of said potentiometer;

a minus voltage power source connected to the number one side of said potentiometer;

said potentiometer shaft passing upwards through said case to and through said drafting rule coupler which is tied tightly to aid shaft, then on upwards to and through a bearing in the top of said case;

means to fix said drafting rule coupler tightly to said case; and said plus and minus power sources to be fixed and equal but opposite polarities and adjusted to give so many volts per degree of rotation.

15. The invention as defined in claim 14 wherein a means to fix said drafting rule coupler tightly to said case comprises;

a threaded hub connected loosely on said output shaft and connected solidly to said top of said case;

a ratchet clutch riding on said threaded hub, said ratchet clutch is threaded to ride on said threaded hub threads and has extrusions on the outside resembling gear teeth;

a clutch plate connected to said threaded hub by pins arranged to retain said clutch plate loosely vertically to said threaded hub but to prevent a circular movement with respect to said threaded hub;

a non slip surface on one side of said clutch plate and the facing portion of said shaft coupler, and the facing portion of the first and second part of said drafting rule coupler;

a wave spring washer between said clutch plate and facing portion of said shaft coupler and the facing portion of the first and second part of said drafting rule coupler to separate said parts when required; and means to turn said ratchet clutch on said threaded hub to bring said non slip surfaces tightly together.

16. The invention as defined in claim 14 wherein means to fix said drafting rule coupler tightly to said case which comprises:

an electro magnet connected solidly to said case, a clutch plate connected to said drafting rule coupler by clutch plate retainers which prevent a circular movement of said clutch plates, and said clutch plates to be made of magnetic material;

a non slip surface to be on the facing portions of said clutch plates and said electro magnets;

wavespring washers between said clutch plates and said electro magnets to push said non slip surfaces apart when disengaged; and means to couple electro magnet power into said output shaft.

17. The invention as described in claim 5 wherein means to compute a correction voltage potential equal to said voltage potential proportional to the change of position of said case multiplied by said multiplier voltage potential for both said RVP and said LVP which comprises;

a two pole position switch connected as follows;

on the A pole side of said switch, position one tied to said variable center tap of said left vanishing point multiplier potentiometer;

position two tied to said variable center tap of said right vanishing point multiplier potentiometer;

on the B pole side of said switch, position one tied to said variable center tap of said left vanishing point potentiometer;

position two tied to said variable center tap of said right vanishing point potentiometer;

means to multiply the voltage on the center tap of said B pole by the voltage on the center tap of said A pole to produce said correction voltage (the computed correction voltage).

* * * * *